United States Patent [19]

Perdiz

[11] Patent Number: 4,507,818

[45] Date of Patent: Apr. 2, 1985

[54] COLLAPSIBLE HAIRBRUSH

[76] Inventor: Antonio L. Perdiz, c/o Mrs. Manuella Gilmore, 912 Bellmore Rd., North Bellmore, N.Y. 11710

[21] Appl. No.: 402,508

[22] Filed: Jul. 28, 1982

[51] Int. Cl.[3] ..... A46B 9/10

[52] U.S. Cl. ..... 15/203

[58] Field of Search ..... 15/203, 184, 185; 132/11 R, 102, 103, 120, 121, 85

[56] References Cited

U.S. PATENT DOCUMENTS

| | | | |
|---|---|---|---|
| 1,631,011 | 5/1927 | Connor | 15/203 |
| 2,814,819 | 12/1957 | Ayerbe | 15/203 |
| 2,815,032 | 12/1957 | Rosenfeld | 132/121 |
| 4,121,314 | 10/1978 | Nathe | 15/203 |

FOREIGN PATENT DOCUMENTS

| | | | |
|---|---|---|---|
| 301497 | 11/1917 | Fed. Rep. of Germany | 132/121 |
| 789759 | 1/1958 | United Kingdom | 15/203 |

*Primary Examiner*—Peter Feldman

*Attorney, Agent, or Firm*—Jordan and Hamburg

[57] ABSTRACT

A collapsible hairbrush comprises a base plate and a plurality of bristle supporting plates arranged in side by side parallel relationship with each other, the bristle supporting plates having upper surfaces and being rotationally situated in the base plate to be moved between a usable position in which the upper surfaces are oriented parallel to the base plate and a folding position in which the upper surfaces are oriented perpendicular to the base plate. A plurality of bristles are attached to the bristle supporting plates to extend substantially upwardly from the upper surfaces of the bristle supporting plates. The hairbrush further includes collapsible means situated in the base plate and is engaged with the bristle supporting plates to move the supporting plates between the usable position and the folding position.

6 Claims, 12 Drawing Figures

COLLAPSIBLE HAIRBRUSH

BACKGROUND OF THE INVENTION

The present invention relates to a collapsible hairbrush, more particularly a hairbrush which can be folded to become substantially flat when the hairbrush is not used.

A hairbrush is very suitable for brushing hair so that the hairbrush is widely used for many people. However, since the hairbrush is not so small like a comb as to be easily carried in a handbag or in a pocket, the hairbrush is generally kept in a place such as a bathroom, locker and so on, through some people still carry a hairbrush. Many attempts have beem made to provide this kind of portable hairbrush. Accordingly, it is desirous to provide a portable or collapsible hairbrush to be easily carried.

Accordingly, an object of the invention is to provide a collapsible hairbrush which can be folded to be substantially flat.

Another object of the invention is to provide a collapsible hairbrush as stated above in which a collapsible mechanism is simple and works reliably.

A further object of the invention is to provide a collapsible hairbrush which can be economically manufactured.

Still further objects and advantages of the invention will be apparent from the following description of the invention.

SUMMARY OF THE INVENTION

In accordance with the invention, a collapsible hairbrush comprises a base plate, and a plurality of bristle supporting plates arranged in side by side parallel relationship with each other on which a plurality of bristles are attached to extend substantially upwardly therefrom. The bristle supporting plates include upper surfaces and are rotationally situated in the base plate to be moved between a usable position that the upper surfaces are oriented parallel to the base plate and a folding position that the upper surfaces are oriented perpendicular to the base plate.

The collapsible hairbrush further comprises collapsible means situated in the base plate and engaged with the bristle supporting plates to move the supporting plates between the usable position and the folding position.

Preferably, the collapsible hairbrush is further provided with a grip slidably connected to the base plate to be held inside the base plate when the hairbrush is folded. Also, the collapsible hairbrush may include a cover removably attached to the base plate for covering the bristles when the hairbrush is folded.

Each bristle supporting plate is provideed with two end shafts attached at longitudinal ends of the supporting plate to be rotationally disposed relative to the base plate, and at least one biased shaft connected to an end of one of the two end shafts. Therefore, when the biased shaft is moved, the bristle supporting plate rotates between the usable position and the folding position.

Preferably, the collapsible means comprises a shifting plate having a plurality of openings for receiving therein the biased shafts of the bristle supporting plates, and at least one shifting projection attached to the shifting plate. When the shifting projection is moved, the shifting plate moves to thereby rotate the bristle supporting plates to the usable position and the folding position.

DETAILED DESCRIPTION OF PREFERRED EMBODIMENTS

Figure 1:
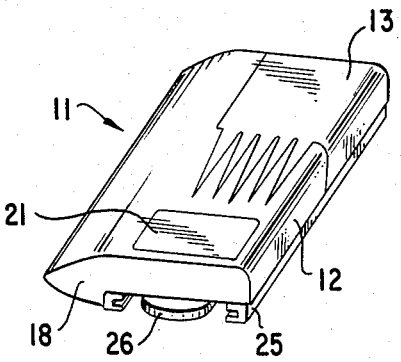
FIG. 1 is a perspective view of a first embodiment of a collapsible hairbrush in accordance with the invention wherein the hairbrush is folded and a cover is attached thereto.
Figure 2:
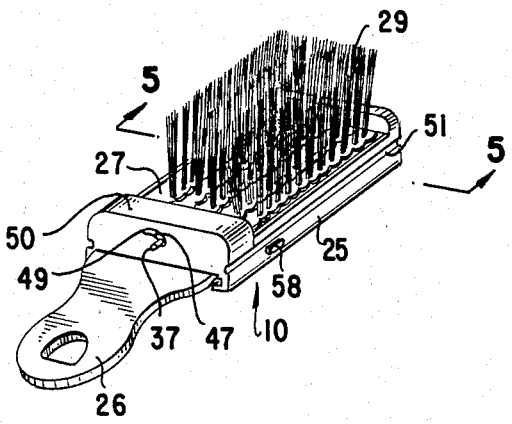
FIG. 2 is a perspective view of a first embodiment of the collapsible hairbrush wherein the hairbrush is assembled for use.
Figure 3:
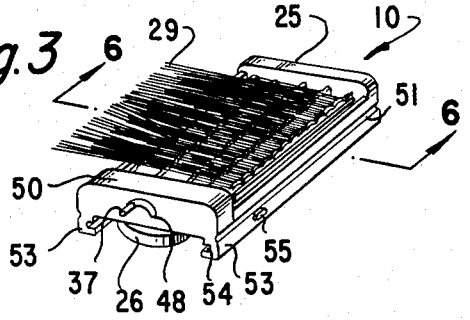
FIG. 3 is a perspective view of a first embodiment of the collapsible hairbrush wherein the hairbrush is folded.

In FIGS. 1–7, a first embodiment 10 of a collapsible hairbrush of the present invention is shown, wherein FIG. 1 shows the hairbrush 10 with a cover 11 in a folding position, and FIG. 2 shows the hairbrush 10 in a usable position. FIG. 3 shows the hairbrush 10 in the folding position without the cover 11. It would be understood that when the hairbrush 10 of the present invention is not used, the hairbrush 10 can be folded to become flat. Therefore, in case the cover 11 is put on the hairbrush 10 as shown in FIG. 1, the hairbrush 10 can be easily carried even in a pocket of a garment.

Figure 4:
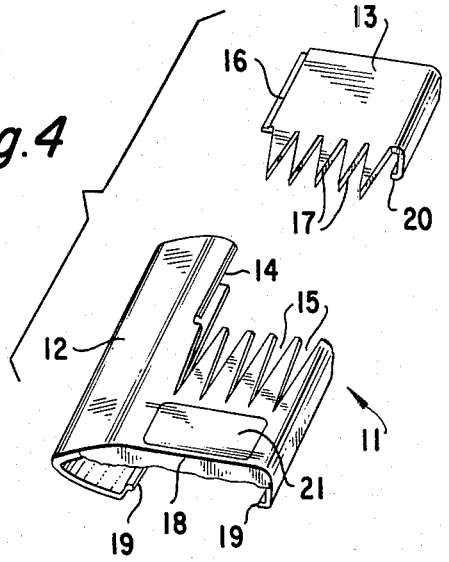
FIG. 4 is a perspective view of a cover to be used for a first embodiment of the hairbrush.

Referring to FIG. 4, the cover 11 to be attahced to the haribrush 10 is shown, and comprises a main section 12 and a comb section 13. The main section 12 includes a groove 14 and five notches 15, while the comb section 13 includes a side projection 16 and five teeth 17 of a comb. The notches 15 and the teeth 17 are the same size, and the projection 16 can be inserted into the groove, so that when the comb section 13 is not used, the comb section 13 can be engaged with the main section 12 to form the complete cover 11.

The main section 12 is further provided with a side wall 18 and two side edges 19 at a bottom part thereof, and the comb section 13 is provided with a side edge 20. The side edges 19, 20 are engaged with the hairbrush 10 to hold the cover 11 thereon. A mirror 21 is attached to the main section 12 for watching hair when brushing.

Figure 7:
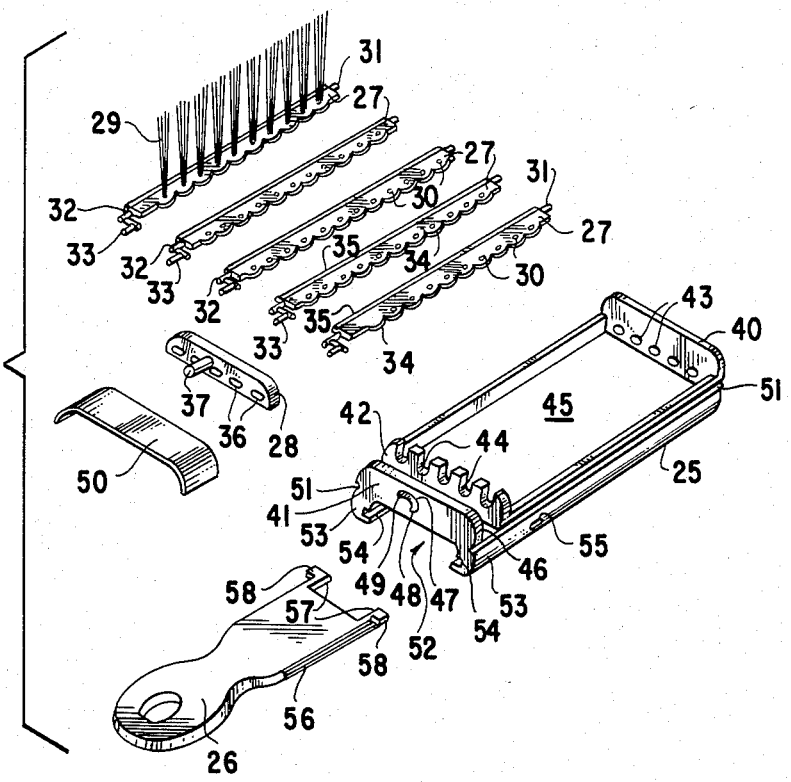
FIG. 7 is an exploded view of a first embodiment of the collapsible hairbrush.

The hairbrush 10 is shown in the exploded view of FIG. 7 as comprising a base plate 25, a grip 26 slidably connected to the base plate 25, five bristle supporting plates 27 rotationally situated in the base plate 25, and a shifting plate 28 for rotating the bristle supporting plates 27. Bristles 29 are attached to the bristle supporting plates 27 to extend upwardly from upper surfaces thereof. In FIG. 7, the bristles 29 are only shown at a left side bristle supporting plate 27, and in the other bristle supporting plates 27, openings 30 for attaching the bristles 29 to the bristle supporting plates 27 are shown. Preferably, the center bristle supporting plate is provided with the largest number of bristles, and the side bristle supporting plates are provided with the smallest number of bristles thereon. Namely, in this particular embodiment, for example, the center bristle supporting plate includes 12 openings 30, the next bristle supporting plates include 11 openings and both side bristle supporting plates include 10 openings.

Figure 5:
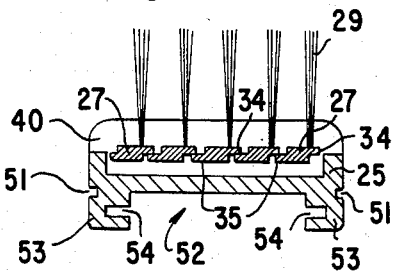
FIG. 5 is a cross section view taken along line 5—5 in FIG. 2.

Each bristle supporting plate 27 is provided with end shafts 31, 32, and a biased shaft 33 connected to the end shaft 32, so that when the end shafts 31, 32 are rotationally situated on the base plate 25 and the biased shaft 33 is moved, the bristle supporting plate 27 rotates relative to the base plate 25. As is clearly shown in FIGS. 5 and 6, the bristle supporting plate further includes an upper edge 34 and a lower edge 35, the edges 34, 35 extending along the longitudinal direction of the plate 27. In the usable position of the hairbrush 10 as shown in FIG. 5, the upper edge 34 is located on the lower edge 35 of the next bristle supporting plate 27. Therefore, the bristle supporting plates 27 cooperate with each other to be held in the usable position.

The shifting plate 28 is provided with five ellipsoidal openings 36 to receive therein the biased shafts 33, and a shifting projection 37 for moving the shifting plate 28. When the shifting plate 28 is moved by the shifting projection 37, the bristle supporting plates 27 are rotated as stated more in detail hereinafter.

The base plate 25 includes end walls 40, 41 and a supporting wall 42 on an upper part thereof. The end wall 40 is provided with five round depressions 43 to receive therein the end shafts 31 of the bristle supporting plates 27, and the supporting wall 42 is provided with five noches 44 to receive the end shafts 32 of the bristle supporting plates 27. Namely, the bristle supporting plates 27 are rotationally situated and supported in a space 45 between the end wall 40 and the supporting wall 42. When the bristle supporting plates are located in the space 45, the biased shafts 33 are situated in a space 46 between the supporting wall 42 and the end wall 41.

The end wall is provided with a curved openings 47 having depressions 48, 49 at both ends thereof. The shifting plate 28 is located in the space 46 so that the shifting projection 37 passes through the opening 47 and the ellipsoidal openings 36 engage the biased shafts 33 therein. When the shifting plate 28 is located in the space 46 as stated above, a space cover 50 is disposed between the end wall 41 and the supporting wall 42. Consequently, the bristle supporting plates 27 are held between the end wall 40 and the supporting wall 42 to only rotate in the space 45.

In this condition, when the shifting projection 37 is moved along the curved opening 47, the bristle supporting plates 27 rotate to move between the usable position and the folding position. Namely, when the hairbrush 10 is in the usable position as shown in FIG. 2, the shifting projection 37 is located in a lower end of the opening 47 and engages the depression 48, so that the bristles 29 on the bristle supporting plates 27 orient to extend upwardly from the base plate 25. Since the openings 36 are not round but ellipsoid slightly, the shifting projection 37 can be moved into the depression 48 to be locked in the usable position.

Figure 6:
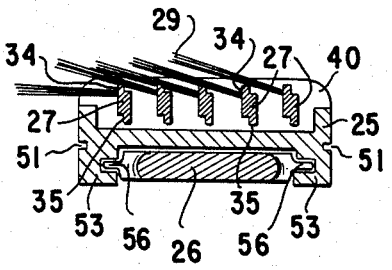
FIG. 6 is a cross section view taken along line 6—6 in FIG. 3.

When the shifting projection 37 is pushed out of the depression 48 and is mvoed upwardly along the curved opening 47, the bristle supporting plates 27 gradually rotate because the biased shafts 33 are moved by the shifting plate 28. When the shifting projection 37 is moved to the uppermost end in the opening 47 and is engaged with the depression 49 for locking in the folding position, the bristle supporting plates 27 orient perpendicular to the base plate 25 as shown in FIGS. 3 and 6. Consequently, the bristles 29 lie on the base plate 25, and the hairbrush 10 becomes substantially flat.

The base plate 25 further includes a pair of elongated grooves 51 along the longitudinal side portions thereof, which can be engated with the side edges 19 of the cover 11. When the bristle supporting plates 27 are moved into the folding position as shown in FIG. 3, the cover 11 as shown in FIG. 4 can be located on the base plate 25 so that the side edges 19 engage the grooves 51. This condition is shown in FIG. 1.

The base plate 25 is further provided with a space 52 at a lower part thereof, and two side margins 53 to define the space 52. The side margins 53 respectively include grooves 54 and openings 55 for holding the grip 26 in the space 52.

The grip 26 includes as shown in FIG. 7, side edges 56, flexible tail ends 57, and projections 58 extending outwardly from the tail ends 57. The side edges 56 of the grip 26 engage the grooves 54 of the base plate 25 so that the grip 26 is firmly and slidably connected to the base plate 25. The projections 58 can be engaged with the openings 55 when they mate together. Accordingly, when the hairbrush 10 is in the folding position, the grip 26 can be fully disposed in the space 52 of the base plate 25. However, when the hairbrush 10 is used, the grip 26 can be pulled out from the space 52. When the projections 58 engage the openings 55, the grip 26 and the base plate 25 are firmly connected together, so that the airbrush 10 can be used as usual by holding the grip 26. When the grip 26 is returned inside the space 52, the projections 58 are pushed not to engage the openings 55. Consequently, the grip 26 can be easily moved back beneath the base plate 25.

FIGS. 8–12 show a second embodiment 70 of the collapsible hairbrush, which has the same function and operation as that of the first embodiment 10. However, the bristles in the first embodiment 10 can be folded perpendicular to the longitudinal direction of the base plate 25, but the bristles in the second embodiment 70 can be folded in the longitudinal direction of the base plate.

Figure 8:
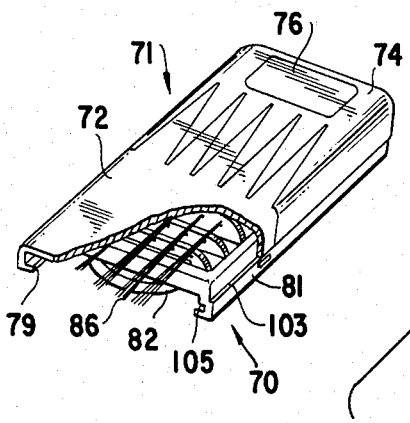
FIG. 8 is a partly broken away perspective view of a second embodiment of a collapsible hairbrush in accordance with the present invention wherein the hairbrush is folded and a cover is attached thereto.
Figure 9:
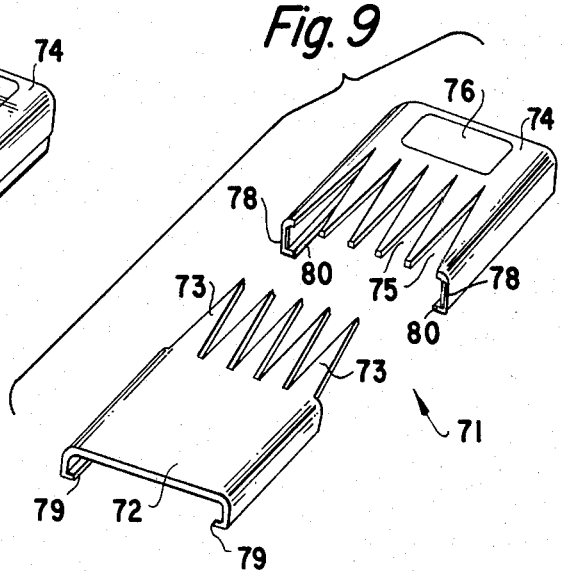
FIG. 9 is a perspective view of a cover to be used for a second embodiment of the hairbrush.
Figure 10:
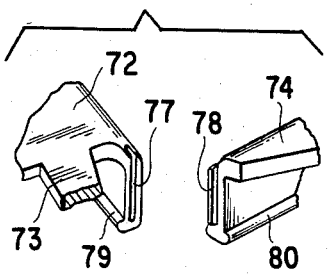
FIG. 10 is an enlarged perspective view of a part of the cover.

When the hairbrush 70 is folded as shown in FIG. 8, a cover 71 can be put thereon as in the hairbrush 10. The cover 71 comprises a comb section 72 having five teeth 73 of the comb, and a section 74 having five notches 75 and a mirror 76. The teeth 73 and the notches 75 are the same size so that they can engage and are connected to each other. In order to connect the comb section 72 to the section 74, the comb section 72 is provided with grooves 77 at side vertical edges, and the section 74 is provided with vertical projections 78 at side vertical edges thereof, which are clearly shown in FIG. 10. When the projections 78 and the grooves 77 are engaged together, the sections 72, 74 form a one piece structure of the cover 71.

The sections 72, 74 are further provided with two side edges 79, 80 at respective bottom parts. The side edges 79, 80 engage the hairbrush 70 to hold the cover 71 thereon. The section 74 includes at an opposite side of the notches 75 a wall like the side wall 18 as shown in FIG. 1, which is not, however, shown in the drawings.

Figure 11:
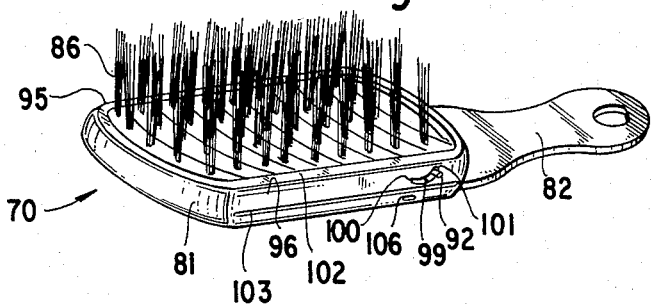
FIG. 11 is a perspective view of a second embodiment of the collapsible hairbrush wherein the hairbrush is assembled for use.
Figure 12:
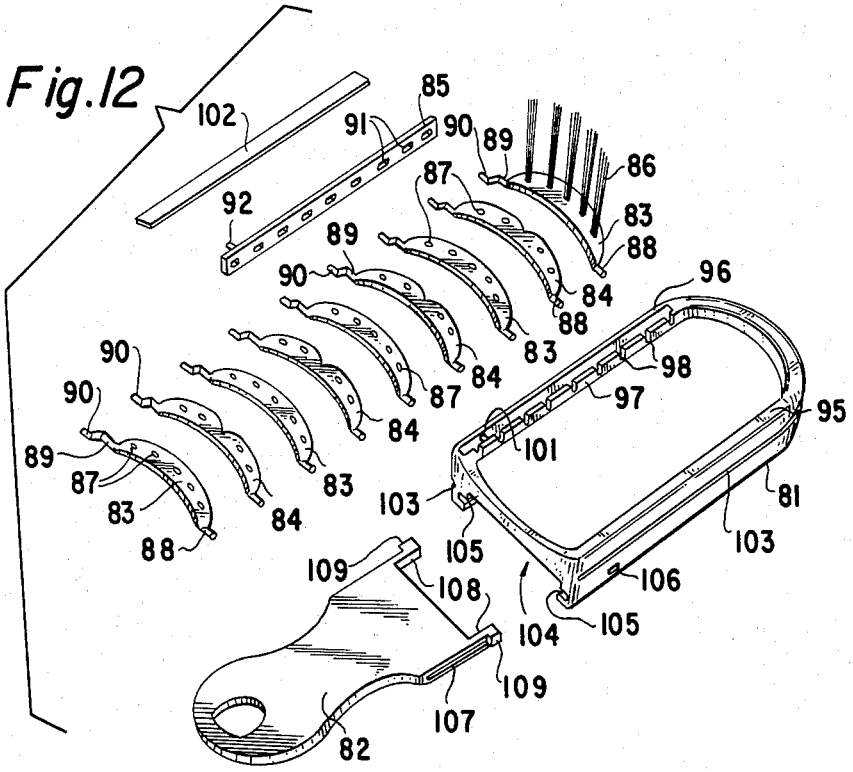
FIG. 12 is an exploded view of a second embodiment of the collapsible hairbrush.

As clearly shown in FIGS. 11 and 12, the hairbrush 70 of the invention comprises a base plate 81, a grip 82 slidably connected to the base plate 81, bristle supporting plates 83, 84 rotationally situated in the base plate 81, and a shifting plate 85 for rotating the bristle supporting plates 83, 84. Bristles 86 are attached to the bristle supporting plates 83, 84 to extend upwardly from upper surfaces thereof. In this embodiment, five bunches of the bristles 86 are only shown at a front end of the bristle supporting plate 83. In the other bristle supporting plates 83, 84, openings 87 for receiving the bristles 86 are only shown. The bristle supporting plates 83 and 84 have the same function and operation, but each plate 83 has a larger number of the bristles than that of the plate 84. In this particular embodiment, the plate 83 includes five bunches of the bristles and the plate 84 includes four bunches of the bristles. The bristle supporting plates 83, 84 are arranged one after another perpendicular to the longitudinal direction of the base plate 81.

The bristle supporting plates 83,84 respectively include end shafts 88,89, and biased shafts 90 connected to the end shafts 89, so that when the end shafts 88,89 are rotationally situated in the base plate 81, the bristle supporting plates 83,84 rotate relative to the base plate 81 by moving the biased shafts 90.

The shifting plate 85 is provided with ellipsoidal openings 91, and a shifting projection 92 extending ouwardly therefrom. The biased shafts 90 are rotationally situated in the openings 91, so that when the shifting projection 92 is moved, the shifting plate 85 moves to thereby rotate the bristle supporting plates 83, 84.

The base plate 81 includes along the longitudinal direction thereof side walls 95,96 and a supporting wall 97 on an upper part thereof. The side wall 95 is provided with round depressions (not shown) like the depressions 43 on the end wall 40 of the first embodiment 10 for receiving the end shafts 88 of the bristle supporting plates 83,84. The supporting wall 97 includes notches 98 to receive the end shafts 89 therein. Therefore, the bristle supporting plates 83,84 are rotationally situated between the side wall 95 and the supporting wall 97, and in this condition, the biased shafts 90 are located between the side wall 96 and the supporting wall 97.

The side wall 96 is provided with a curved opening 99 having depressions 100,101 at both ends thereof. The shifting plate 85 is situated between the side wall 96 and the supporting wall 97 so that the shifting projection 92 extends through the curved openings 99 and the biased shafts 90 engage the openings 91. After the shifting plate 85 is located in place, a space cover 102 is attached between the side wall 96 and the supporting wall 97. Consequently, the bristle supporting plates 83, 84 and the shifting plate 85 are properly situated in the base plate 81.

When the shifting projection 92 is moved along the curved opening 99 to an uppermost end, the bristles 86 stand upwardly relative to the base plate 81 as shown in FIG. 11. If the shifting projection 92 is pushed into the depression 101, the shifting projection 92 stays in this usable position. When the shifting projection 92 is, on the contrary, moved to a lowermost end, the bristle supporting plates 83, 84 are rotatated to the folding position as partly shown in FIG. 8. If the shifting projection 92 is moved into the depression 100, the bristle supporting plates are locked in this folding position.

The base plate 81 includes a pair of elongated grooves 103 to engage the side edges 79, 80 of the cover 71, so that the cover 71 can be properly fitted on the base plate 81. Also, the base plate 81 includes a space 104, grooves 105 and openings 106 like those explained about the grip 26 of the first embodiment. Namely, the side edges 107 are slidably engaged with the grooves 105, and the projections 109 can be engaged with the openings 106 when the grip 82 is extended for using. The grip 82 can be fully returned inside the space 104 when the hairbrush 70 is folded.

In accordance with the invention, the hairbrush can be simply and easily assembled and folded. When the hairbrush is folded, the hairbrush becomes compact to be carried without bulkiness.

While the invention has been described with reference to the specific embodiments, it is to be noted that the description is illustrative and the invention is to be limited only by the appended claims.

What is claimed is:

1. A collapsible hairbrush comprising, a base plate including a rectangular base member, first and second end walls situated at the longitudinal ends, said end walls extending upwardly from the base member, said first end wall having a plurality of depressions at the inner side of the base member, said second end wall having a curved opening with locking depressions at both ends thereof, a supporting wall adjacent and parallel to the second end wall, said supporting wall having a plurality of notches, number of which corresponds to the number of depression at the first end wall, a space being formed between the supporting wall and the second end wall, two outer grooves provided along the longitudinal outer sides of the base member, and two side margins extending downwardly from the longitudinal outer sides of the base member, said side margins having two inner grooves at the respective inner sides thereof and at least two groove openings provided at the respective inner grooves, a plurality of bristle supporting plates, number of which corresponds to the number of the depressions of the first end wall and the notches of the supporting wall, each bristle supporting plate having a main member, a first end shaft attached to an end of the main member and rotationally situated in the depression of the first end wall, a second end shaft attached to the end of the main member opposite to the first end shaft and rotationally situated in the notch of the supporting wall, and a biased shaft connected to the second end shaft so that the biased shaft is located in the space between the supporting wall and the second end wall, said main member having an upper surface, an upper edge situated along one longitudinal side of the main member and a lower edge situated along the other longitudinal side of the main member so that when the biased shafts are moved, the main members rotate between a usable position that the upper surfaces of the main members are oriented parallel to the base member of the base plate in which the upper edges of the main members are located on the lower edges of the adjacent main members to thereby support the edges of the main members with each other and a folding position that the upper surfaces are oriented perpendicular to the base member, a plurality of bristles attached to said bristle supporting plates to extend substantially upwardly from the upper surface of the main member, collapsible means situated in the space between the supporting wall and the second end wall, said collapsible means including a shifting plate having a plurality of openings for receiving the biased shafts of the bristle supporting plates, and at least one shifting projection connected to the shifting plate, said shifting projection extending through the curved opening of the second end wall so that when the shifting projecting is moved along the curved opening, the shifting plate moves to thereby rotate the bristle supporting plates between the usable position and the folding position, said shifting plate, when the shifting projection is disposed in the locking depressions, being locked in one of the usable position and the folding position, a space cover for covering the space between the supporting wall and the second end wall so that the shifting plate can be kept inside the space cover, a cover having side edges along the longitudinal edges thereof, said side edges being engageable with the outer grooves of the base plate so that when the hairbrush is folded, the bristles and the base plate can be covered, and a grip having flexible tail ends with projections extending outwardly from the tail ends, and side edges engaging the inner grooves of the side margins of the base plate, said grip being held between the side margins when the hairbrush is folded and being extended from the side margins when the hairbrush is used so that the projections are engaged with the groove openings.

2. A collapsible hairbrush according to claim 1, in which said cover comprises a main section and a comb section detachably connected to said main section, said comb section having a plurality of teeth of the comb so that when the comb section is detached from the main section, the comb section can be used as a comb.

3. A collapsible hairbrush according to claim 2, in which said cover includes a mirror attached on an outer surface of the main section.

4. A collapsible hairbrush comprising, a base plate including a rectangular base member, first and second end walls situated at the ends perpendicular to the longitudinal direction of the base member, said end walls extending upwardly from the base member, said first end wall having a plurality of depressions at the inner side of the base member, said second end wall having a curved opening with locking depressions at both ends thereof, a supporting wall adjacent to and parallel to the second end wall, said supporting wall having a plurality of notches, number of which corresponds to the number of depression at the first end wall, a space being formed between the supporting wall and the second end wall, two outer grooves provided along the longitudinal outer sides of the base member, and two side margins extending downwardly from the longitudinal outer sides of the base member, said side margins having two inner grooves at the respective inner sides thereof and at least two groove openings provided at the respective inner grooves, a plurality of bristle supporting plates, number of which corresponds to the number of the depressions of the first end wall and the notches of the supporting wall, said bristle supporting plates including first and second bristle supporting plates to be arranged one after another on the base plate to be oriented perpendicular to the longitudinal direction of the hairbrush, each bristle supporting plate having a main member, a first end shaft attached to an end of the main member and rotationally situated in the depression of the first end wall, a second end shaft attached to the opposite end of the main member and rotationally situated in the notch of the supporting wall, and a biased shaft connected to the second end shaft so that the biased shaft is located in the spece between the supporting wall and the second end wall, said main member having an upper surface, an upper edge situated along one longitudinal side of the main member and a lower edge situated along the other longitudinal side of the main member so that when the biased shafts are moved, the main members rotate between a usable position that the upper surfaces of the main members are oriented parallel to the base member of the base plate in which the upper edges of the main members are located on the lower edges of the adjacent main members to thereby mutually support the edges of the main members with each other and a folding position that the upper surfaces are oriented perpendicular to the base member, a plurality of bristles attached to said bristle supporting plates to extend substantially upwardly form the upper surface of the main member, said first bristle supporting plate having a larger number of the bristles thereon than the second bristle supporting plate, collapsible means situated in the space between the supporting wall and the second end wall, said collapsible means including a shifting plate having a plurality of openings for receiving the biased shafts of the bristle supporting plates, and at least one shifting projection connected to the shifting plate, said shifting projection extending through the curved opening of the second end wall so that when the shifting projecting is moved along the curved opening, the shifting plate moves to thereby rotate the bristle supporting plates between the usable position and the folding position, said shifting plate, when the shifting projection is disposed in the locking depressions, being locked in one of the usable position and the folding position, a space cover for covering the space between the supporting wall and the second end wall so that the shifting plate can be kept inside the space cover, a cover having side edges along the longitudinal edges thereof, said side edges being engagable with the outer grooves of the base plate so that when the hairbrush is folded, the bristles and the base plate can be covered, and a grip having flexible tail ends with projections extending outwardly from the tail ends, and side edges engaging the inner grooves of the side margins of the base plate, said grip being held between the side margins when the hairbrush is folded and being extended from the side margins when the hairbrush is used so that the projections are engaged with the groove openings.

5. A collapsible hairbrush according to claim 4, in which said cover comprises a main section and a comb section detachably connected to said main section, said comb section having a plurality of teeth of the comb so that when the comb section is detached from the main section, the comb section can be used as a comb.

6. A collapsible hairbrush according to claim 5, in which said cover includes a mirror attahced on an outer surface of the main section.

* * * * *